United States Patent [19]

Andriash

[11] Patent Number: 4,953,746

[45] Date of Patent: Sep. 4, 1990

[54] ONE-AT-A-TIME COUPON DISPENSER

[76] Inventor: Michael Andriash, P.O. Box 3881 Main Post Office, Vancouver, B.C., Canada, V6B 3Z3

[21] Appl. No.: 230,479

[22] Filed: Aug. 10, 1988

Related U.S. Application Data

[63] Continuation-in-part of Ser. No. 23,405, Mar. 9, 1987, abandoned.

[51] Int. Cl.[5] ..... B65H 1/02; B65H 1/12

[52] U.S. Cl. ..... 221/35; 221/45; 221/59; 221/63; 312/61

[58] Field of Search ..... 221/33, 34, 35, 45, 221/46, 58, 59, 60, 63, 282, 283, 285, 303, 312 R, 312 C; 312/50, 60, 61, 71; 206/556, 555, 562, 563, 233, 44 B, 44.12, 45.16, 215, 449; 40/651, 124, 124.4, 124.2; 248/221.3, 231.8, 220.2

[56] References Cited

U.S. PATENT DOCUMENTS

| | | | |
|---|---|---|---|
| 1,020,175 | 3/1912 | Arnold | 40/124 X |
| 1,678,339 | 7/1928 | Horwitt | 221/35 |
| 1,734,045 | 11/1929 | Parran | 221/282 X |
| 1,739,801 | 12/1929 | Pitts | 206/233 X |
| 1,783,414 | 12/1930 | Daniels | 221/35 |
| 2,101,307 | 12/1937 | Bodette | 221/59 |
| 2,464,426 | 3/1949 | Williams | 221/58 |
| 3,068,055 | 12/1962 | Lenzi et al. | 221/59 X |
| 3,071,289 | 1/1963 | Taylor | 221/35 X |
| 3,147,856 | 9/1964 | Lightner et al. | 206/232 |
| 3,381,853 | 5/1968 | Ferris et al. | 221/63 |
| 3,604,562 | 9/1971 | Loeffler | 221/56 X |
| 3,881,649 | 5/1975 | Krautsack | 206/460 X |
| 4,130,197 | 12/1978 | Fox | 40/124.2 X |
| 4,179,138 | 12/1979 | Bogdanovic | 40/124.2 X |
| 4,384,418 | 5/1983 | Alley | 40/651 |
| 4,586,631 | 5/1986 | Loder | 221/58 |
| 4,623,073 | 11/1986 | Hansen | 221/45 |
| 4,805,331 | 2/1989 | Boggess et al. | 211/59.2 X |

FOREIGN PATENT DOCUMENTS

| | | | |
|---|---|---|---|
| 532808 | 11/1956 | Canada | 206/449 |
| 2417688 | 11/1974 | Fed. Rep. of Germany | 221/58 |
| 186224 | 11/1936 | Switzerland | 206/449 |
| 593830 | 12/1977 | Switzerland | 206/556 |

*Primary Examiner*—F. J. Bartuska

[57] ABSTRACT

A sheet dispenser for dispensing one sheet at a time comprises an enclosure for holding a stack of, individual sheets. A biasing element is provided for resiliently urging a stack of individual sheets against a front wall of the enclosure. The enclosure front wall has an opening provided therein through which a front sheet of a stack of sheets is withdrawn by a user's fingers. The opening has a height dimension at least approximately equal to the height dimension of a front sheet of a stack of sheets. The opening has a width dimension sufficient to permit a user to insert at least one finger into the opening, drag a section of a front sheet across the opening and fold a portion of a front sheet outwardly of a stack of sheets through the opening to enable withdrawal of an entire front sheet from a stack of sheets. The front wall has portions inclined from the opening rearwardly towards either end forming planer or concave surfaces.

7 Claims, 5 Drawing Sheets

ONE-AT-A-TIME COUPON DISPENSER

FIELD OF THE INVENTION

This application is a continuation-in-part, of application Ser. No. 07/023,405 filed Mar. 9, 1987 now abandoned.

This invention relates to a sheet dispenser which permits one-at-a-time withdrawal of a sheet from a stack of sheets presented from within the dispenser.

BACKGROUND OF THE INVENTION

Many forms of display devices for dispensing items have been developed. The display devices are structured in a way dependent upon the type of units to be displayed and released. For example, a very early form of display cabinet is of the type shown in U.S. Pat. No. 1,706,240. In that system, lids may be lifted upwardly when released to permit withdrawal of contents from within the display cabinet. With this arrangement, users can extract from the display cabinet as much material as they wish. A similar concept has been applied to sheet material which may be in the form of brochures and other types of advertising material, discount coupons and the like. Dispensers for large sheet material may be of the type such as shown in U.S. Pat. Nos. 1,739,801 and 4,130,197. In these devices, the sheets as presented in the holder may be readily extracted by the user. There is no limit however on the number of sheets which may be extracted from the unit. In the area of discount coupons, holders such as those shown in U.S. Pat. No. 3,881,649 may be used. The holders are adapted to be readily attached to store shelves to present coupons which may be removed by the user for redemption at the check-out counter. However, the user may remove as many coupons as they desire. An attempt to reduce the number of coupons that may be removed from a dispenser is contemplated in U.S. Pat. No. 3,147,856. In thwarting access to the coupons it becomes very difficult to even remove one coupon at a time from the unit.

Other types of one-at-a-time dispensers are disclosed in U.S. Pat. No. 3,068,055 and Canadian Industrial Design Registration No. 54860. The United States patent discloses a household napkin holder and dispenser which provides for removal of one serviette at a time from the holder. Due to the flimsy nature of the serviettes, jamming can occur at the removal slot of the holder. A similar problem can be encountered with the discount coupon dispenser of the industrial design registration.

U.S. Pat. No. 3,381,851 issued May 7, 1968 to Ferris et al discloses an arcuate strip dispenser with a large central opening for insertion of the fingers and removal of a strip. The large opening makes it easy to insert a finger over an edge of a stack of strips and remove several strips at one time. Moreover, only a limited number of strips in a stack can be accommodated as there is no means for biasing the stack against the front wall.

Swiss Patentschrift No. 186224 published Nov. 16, 1936 by Hug discloses a dispenser with a cruciform shaped opening centrally in the front wall and a solid sheet spring bent at the center with two concave faces each extending back to contact the back wall proximate respective ends of the enclosure. Total movement of the spring is limited by the movement allowed at the ends. Too much spacing between the ends of the spring and side walls of the enclosure can result in misalignment of the spring and jamming of the sheets. Moreover, since the front wall does not conform to the shape of the stack as determined in this case by the spring, the ends of the sheets in the stack will not be held together when the thickness of the stack is reduced to the point where the front sheet does not contact the front wall. At that point it will be possible to extract more than one sheet.

Accordingly this invention provides a one-at-a-time sheet dispenser. The sheets to be dispensed are normally of a single sheet thickness and of varying dimensions. The preferred type of sheets to be dispensed are the discount coupons which are normally of a dollar bill size.

The invention provides a dispenser which ensures that a single sheet is removed from the dispenser one at a time to thwart any effort by the user to take several sheets at a time.

SUMMARY OF THE INVENTION

According to one aspect of the invention, there is provided a sheet dispenser for dispensing one sheet at a time which includes a hollow enclosure for holding a stack of individual sheets and a means for resiliently urging the stack forwardly against a front of the enclosure for stack thicknesses as thin as 1 sheet. The enclosure has a front wall and an opening therein, the height of which is equal to the height dimension of the sheets and a width dimension being sufficient to permit a user to insert at least one finger into the opening and fold a portion of the front sheet outwardly from a stack of sheets through the opening. A front wall has front wall portions inclined from the opening rearwardly toward the ends forming planar or slightly concave surfaces. The formation of such surfaces holds the coupons in a shape in which the region near the center more readily folds for removal from the enclosure. A convex rounded shape makes it more difficult to fold the coupon without pinching the fold and/or ripping the coupon. The reason for this is that pinching is more effective the greater the angle of inclination at the point of contact.

Preferably the dispenser includes an outwardly extending flange around the opening in the front wall which inhibits a user s fingers from insertion onto a top or bottom edge of the stack of sheets.

According to another aspect of the invention, there is provided a sheet dispenser for dispensing one sheet at a time which includes a pair of separable hollow enclosures, each of which holds a stack of individual sheets. Each enclosure has means for resiliently urging an associated stack of sheets against a corresponding one of the front walls. Means are provided for mounting the enclosure at one side to a shelf edge such that the enclosures extend outwardly of the shelf edge and front walls thereof face in opposite directions parallel to the shelf edges. In this way the items on the shelf are not hidden by the dispenser. Moreover, the dispenser can be mounted immediately in front of the items with respect to which the advertising coupons relate.

Preferably the mounting means is flexible so as to permit rotation of the dispenser about a vertical axis.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
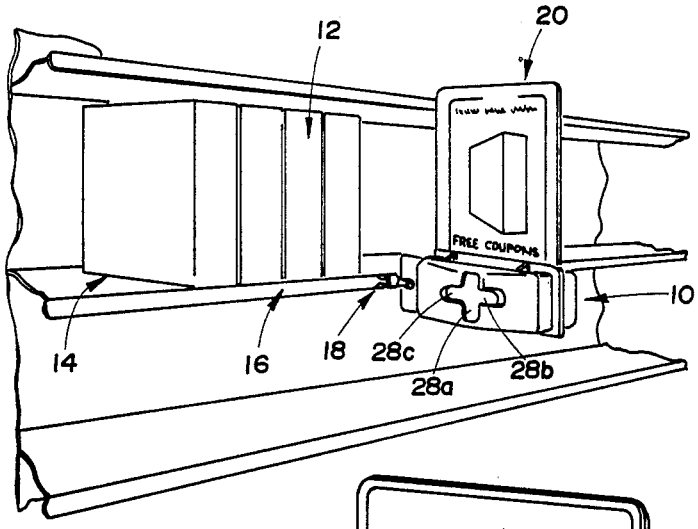
FIG. 1 is a perspective view of the sheet dispenser adapted to dispense coupons at the display shelf.

As shown in FIG. 1, the sheet dispenser 10 is used in association with the product 12 as displayed on the shelving unit 14. The sheet dispenser 10 is coupled to the shelving edge 16 by way of a coupling device 18. The sheet dispenser 10 includes a feature board 20 which attracts the attention of the consumers to the fact that, if they purchase the particular product 12, a discount coupon may be obtained from the dispenser 10 and redeemed at the check-out counter. It has been conclusively shown that such advertising at the point of purchase is very effective and persuasive in convincing the consumers to try the product 12 or to realize a better price on the product 12 which they would normally purchase. Due to the small dollar bill size of the coupon, it is therefore advantageous to provide on top of the dispenser a feature board 20. The feature board may be of standard print size, such as 8"×12". The user of system can therefore include on the feature board the necessary advertising information to attract the consumer's attention. The size of the dispenser and its arrangement in extending perpendicularly to the shelf edge is important in that only one to two inches of price rail strip is taken up by the system. This minimizes problems in interfacing the system with the price rail strip, price identification tags and shelf scanning devices currently used by retailers. The system also does not interfere with loading of the shelf on which the device is mounted, or unloading shelves below this device. Furthermore, it does not obstruct the consumer's view to any appreciable extent.

However, care must be exercised to ensure that the discount coupon system is not abused. Hence it is important that the sheet dispenser 10 only dispense one sheet at a time: otherwise the consumer or fraudulent cashiers or store keepers could take several coupons and convert them into cash. Certainly the consumer is going to be discouraged from extracting several discount coupons if only one can be obtained at a time. Conclusive documented surveys have demonstrated that 98% of the shoppers will only remove one or two coupons from a one-at-a-time type dispenser, such as the system noted in Canadian Industrial Design registration No. 54860. This is particularly important to the user of the system, in that its coupon promotion does not overly subsidize the consumer base.

Figure 2:
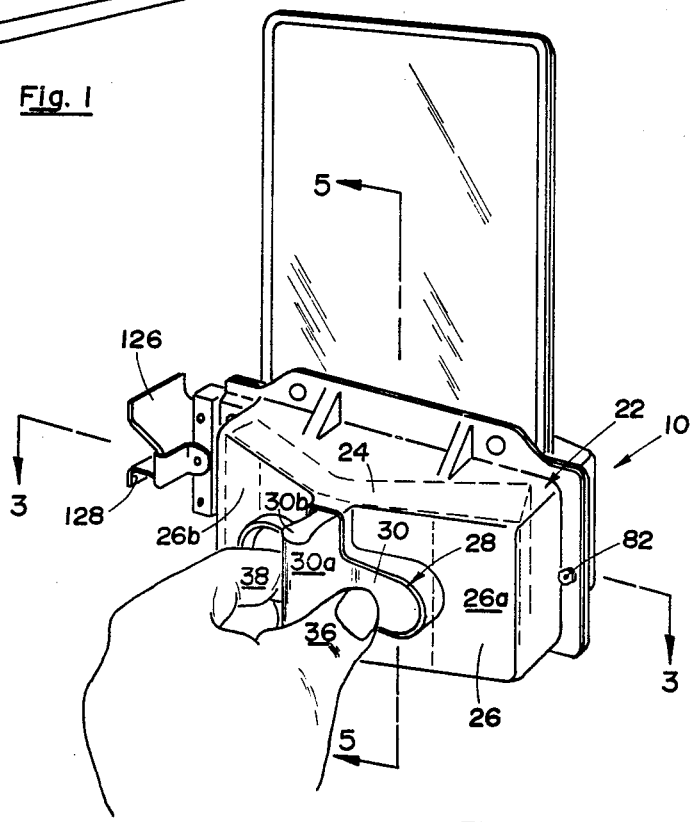
FIG. 2 is an enlarged perspective view of the dispenser of FIG. 1.

FIG. 2 shows the manner in which one sheet in the form of a discount coupon or the like is obtained. The dispenser 10 has an enclosure 22 which contains a stack of sheets 24 as shown in dot. The stack of sheets 24 are resiliently biased against the front wall 26 by means which will be described in more detail with, reference to FIG. 3. The enclosure face 26 includes an opening generally designated 28 which permits the consumer to insert two or more fingers into the opening and draw the exposed portions of the coupon sheet towards each other. This causes the individual coupon 30 to fold and form outwardly extending portions 30*a* and 30*b*. With the folded portions 30*a* and 30*b* now extended outwardly of the opening 28, the consumer may grasp the folded portions and complete withdrawal of the individual coupon 30 from the dispenser enclosure 22.

Figure 3:
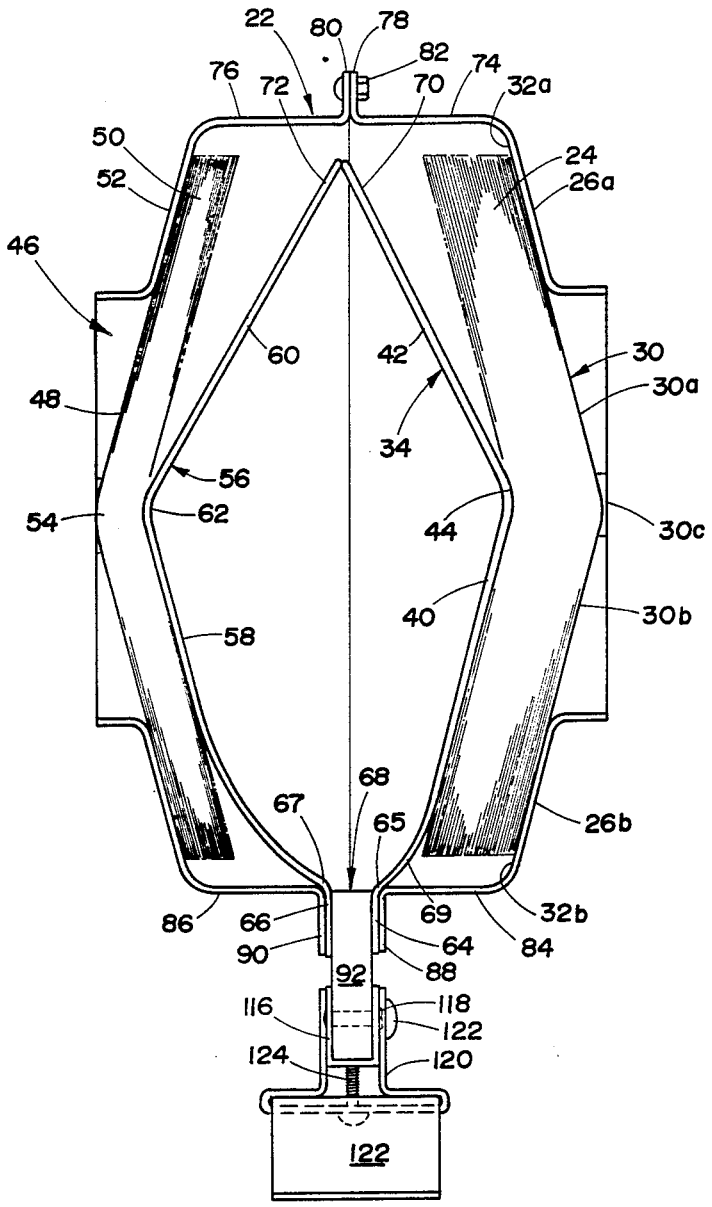
FIG. 3 is a section taken along the lines 3—3 of FIG. 2.

According to a preferred embodiment of the invention, the enclosure face 26 is generally convex in shape. The individual wall sections 26*a* and 26*b* slope outwardly and rearwardly of the centre of the front wall in two planes, respectively, as shown in FIG. 3. As the stack of coupons 24 is resiliently urged against the interior surfaces 32*a* and 32*b* of the enclosure face 26, by the spring device 34, the stack of sheets 24 take on the shape of the front face 26 to present the outer coupon 30*a* with an apex portion 30*c*.

The opening 28 is shaped in a manner to readily permit the consumer to insert two or more fingers in the manner shown in FIG. 2. The opening 28 is cross-shaped in configuration as shown in FIG. 1. There is a vertically extending rectangular-shaped portion 28*a* which essentially extends the height of the sheet or coupon to be withdrawn from the dispenser 10. Extending transversely of the opening 28*a* are openings 28*b* and 28*c*. The openings 28*b* and 28*c* permit insertion of the user's fingers which may conveniently be the user's thumb 36 and one or more fingers 38. By frictional engagement of the fingers with the face of the individual coupon 30, the contacted portions 30*a* and 30*b* may be drawn together and folded outwardly through the opening 28*a* to the extent shown in FIG. 2. With this puckered portion of the coupon extending outwardly of the dispenser 10, the consumer can now firmly grip the individual coupon and complete withdrawal from the dispenser 10 through the vertically extending opening 28*a*.

According to an aspect of the invention, the device for resiliently urging the stack of coupons 24 against the interior faces 32*a* and 32*b* of the enclosure face 26, is shown in FIG. 3. The device comprises a resilient member 34 which is bent in a convex manner to resemble the convex shape of the outer face 26. The resilient member 34 includes leg portions 40 and 42 which meet at apex 44. The apex 44, as it presses against the stack 24, causes the stack of coupons to take on the shape of the interfaces 32*a* and 32*b* of the enclosure wall 26. Hence the stack 24 presents an apex 30*c* prominent in the region of the vertically extending opening 28*a*. Such convex shape for the face of the outer coupon 30 assists in the user grasping the outer portions 30*a* and 30*b* of the coupon to form the folded portion extending outwardly of the opening 28*a*.

With the embodiment of FIG. 3, the resilient device 34 may be formed of a spring steel or plastic with sufficient memory to constantly urge the stack of coupons 24 against the dispenser face 26 until all of the coupons have been dispensed. With this particular embodiment, the dispenser has two dispensing faces on opposite sides of the enclosure 22. A similar opening 46 is provided to permit withdrawal of an outer coupon 48 from the second coupon stack 50. The second coupon stack 50 is resiliently biased against the enclosure face 52 to present an apex portion 54 so that the user may readily extract the outer coupon in accordance with the method discussed with respect to other coupon stack 24. With this arrangement, opposing resilient devices 34 and 56 may be used. Device 56 consists of two legs 58 and 60 with an apex portion 62. Legs 40 and 58 may have their end portions 64 and 66 fixed at the base 68 of the enclosure 22. The distal free ends 70 and 72 contact one another in the manner shown. Hence the resilient devices 34 and 56 cooperate with each other in resiliently urging the respective stacks of coupons 24 and 50 against the faces 26 and 52 of the dispenser enclosure. Each resilient device 34 and 56 is sufficiently bent so that when most if not all except the last two coupons are to be dispensed from each side of the dispenser, they are still held outwardly at the respective openings 28 and 46. Hence, this type of fixed resilient material provides an economical device for biasing the respective stacks of coupons against the enclosure faces.

It is appreciated that a variety of arrangements may be provided for the resilient devices 34 and 56. For example, the resilient devices, as they have their base portions 64 and 66 secured at the base 68 of the enclosure, may be spring loaded in the regions 65 and 67 so as to normally push the respective apexes 44 and 62 to the outermost portions of the front walls of the enclosures. For example, the plastic element 34 may be biased in region 65. when located in the position shown in FIG. 3. This is indicated by the curvature noted in region 69. When the element 34 is in its normal rest position, the apex 44 may be extending outwardly into the opening without any need for a contact between the distal portions 70 and 72 of the respective spring elements to achieve such bias.

Figure 5:
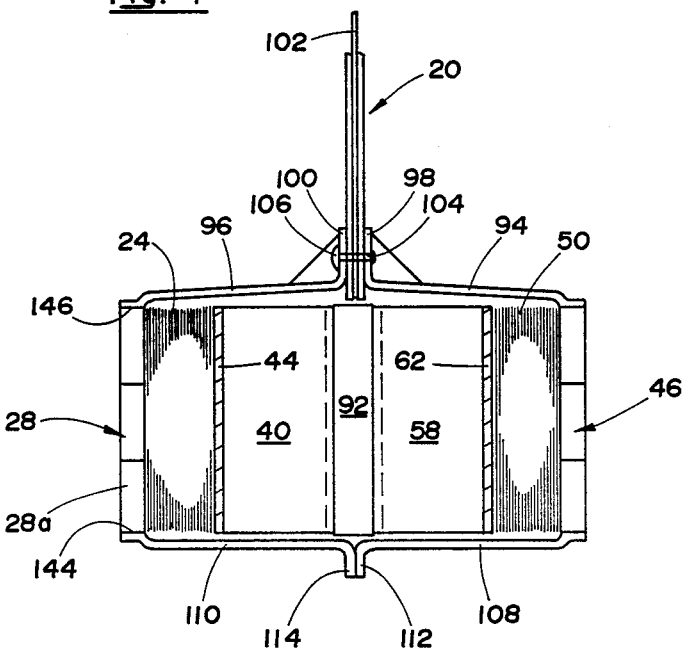
FIG. 5 is a section taken along the lines 5—5 of FIG. 2.

The dispenser enclosure 22 in addition to the faces 26 and 52 has end walls 74 and 76 joined at flanges 78 and 80 by appropriate releasable fasteners such as threaded bolts 82. Similarly, end walls 84 and 86 are joined at flanges 88 and 90 to connector element 92 with the ends 64 and 66 sandwiched therebetween. An appropriate mechanical fastener such as a threaded bolt or the like may be used to secure the ends 88 and 90 together and directly to the connector member 92. The enclosure also has upper walls 94 and 96 connected at flanges 98 and 100, as shown in FIG. 5. According to this embodiment, the feature card 102 of the display board 20 is affixed at its base 104 by mechanical fastener 106. The bottom of the enclosure includes wall portions 108 and 110 which are interconnected at flanges 112 and 114 by an appropriate mechanical fastener.

Figure 4:
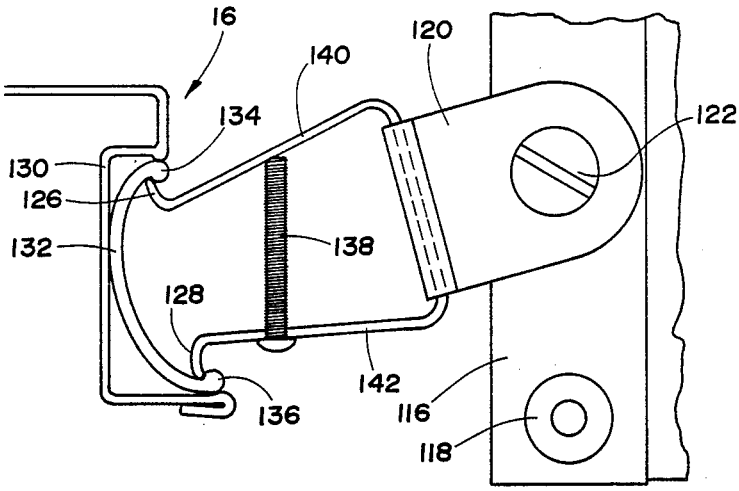
FIG. 4 is an enlarged view of the display enclosure holder of FIG. 2 as mounted in a shelf clip.

The connector member 92 is mounted in a U-shaped bracket 116 as shown in FIG. 3. The U-shaped bracket is secured to the connector 92 by way of rivets 118. A yoke 120 is secured to the U-shaped bracket 116 by way of a bolt 122. The yoke 120 encases a clip 122 which is secured in position by way of threaded bolt 124. The clip 122, as shown in FIG. 2, has outwardly extending flanges 126 and 128. These flanges may be clipped into the corresponding edge portion 16 of a shelf in the manner shown in FIG. 4. A standard display shelf 16 includes a channel edge portion 130 which has mounted therein an arcuate shaped member 132 with opposing flanges 134 and 136. Opposing clip flanges 126 and 128 are then clipped behind the edges 134 and 136. To secure the clip in place, a threaded bolt 138 is used to expand the leg portions 140 and 142 to firmly position the clips 126 and 128 behind the flanges edges 134 and 136.

The connector member 92 may be of a resilient material such as rubber and other synthetic plastics such as plasticized polyvinyl chloride. This permits lateral movement of the dispenser enclosure 32. This is particularly important where the dispenser is mounted on the shelf edge. Consumers walking along aisles adjacent the shelves may inadvertently bump into the dispensers. The flexible connector member 92 readily flexes to ensure that the dispenser enclosure is not damaged should it be accidentally struck. Furthermore, the enclosure walls may also be made from a resilient type of plastic material which is not readily broken. By forming the walls of such material, to replace the coupon stacks 24 and 50, simply requires releasing of the fastener 82 and spreading the enclosure walls apart to permit withdrawal of existing stacks and insertion of new stacks and/or replacement of same in front of the respective spring members 34 and 56. In the event that the dispenser enclosure has only one dispensing face, then a back wall may be provided on the enclosure against which the resilient member 34 is biased. To replace coupons, it would simply be a matter of removing the back wall and by pushing the spring member 34 aside, coupons can be reinserted.

As shown in FIG. 5, the vertically oriented opening **28*a* has lower edge 144 and upper edge 146. The distance between the opposing edges 144 and 146 is approximately equal to the height of the coupon to be removed. In view of the coupon stack also contacting the interior surfaces of the outer face, it is appreciated that the opening 28*a* may be of a height which provides a distance from edges 144 to 146** greater than the height of the coupon to be withdrawn from the dispenser. In some situations, this may facilitate coupon withdrawal and also accommodate alternative configurations for the coupon which may be other than rectangular, such as an elongated oval shape.

It is appreciated that alternative connecting arrangements may be used in mounting the dispenser enclosure on the shelf edge. Such brackets may be formed of injection molded plastic materials which have hinge structures providing for pivotal movement of the dispenser enclosure with the additional feature of self-centering so that in the normal position, the dispenser enclosure is projecting perpendicularly from the edge portion of the display shelf.

Figure 6:
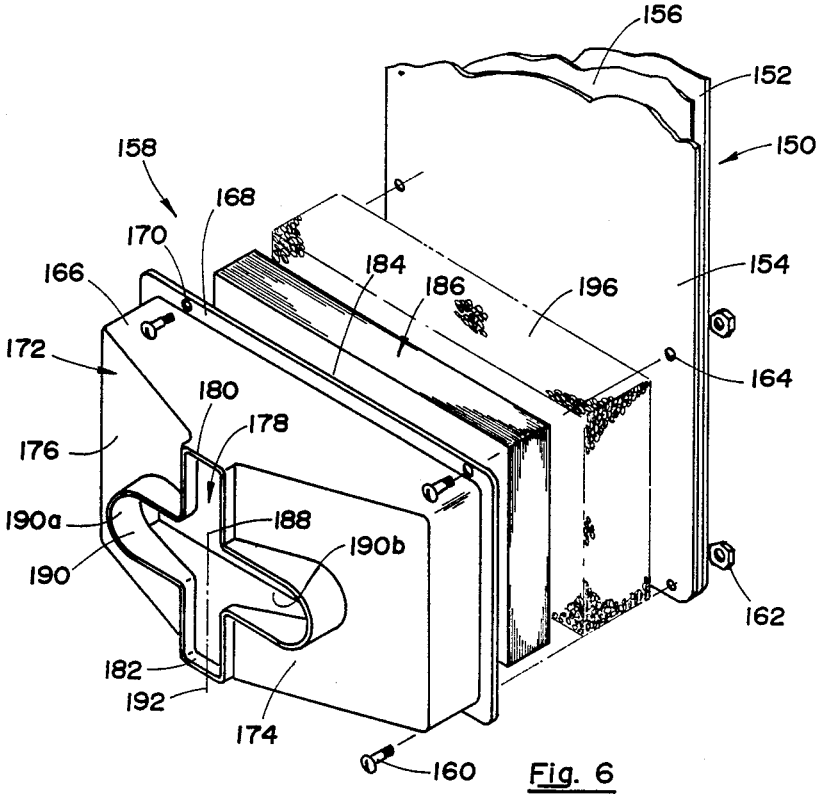
FIG. 6 is an exploded view of an alternative embodiment for the coupon dispenser.

It is appreciated that the coupon dispenser may be mounted in locations other than on shelf edges. For example, it may be mounted on a backing plate of a carousel or product display or the like. As shown in FIG. 6, a backing plate 150 consists of an opaque plate 152 with transparent outer plate 154. An advertising message 156 may be sandwiched between the transparent and opaque plates 152 and 154. The coupon dispenser 158 may be mounted against the plate 150 by use of the fasteners consisting of bolts 160 and nuts 162 which extend through the respective apertures 164. According to this embodiment, the dispenser enclosure is defined by a enclosure shell 166 mounted against the plate 150. The shell includes a flange 168 to accommodate the fasteners 160 used in securing the shell to the plate as they fasteners extend through the respective apertures 170. The shell 166 includes a front wall 172 consisting of front wall sections 174 and 176. According to this embodiment, the front wall sections 174 and 176 are planar and extend outwardly towards each other away from the back plate 150. This provides an overall convex shape to the front wall 172. The opening 178 to permit withdrawals of the coupons one at a time is of a height dimension such as that shown in FIG. 5, where the distance from the inside surfaces of flanges 180 and 182 is approximately equal to or slightly greater than the overall height of the front coupon 184 of the stack 186. The opening 178 consists of two sections, a vertically extending section 188 and a transversely extending section 190. The vertically extending section 188 has a central axis 192. According to this preferred embodiment, the transversely extending section 190 is located medially of the vertical section and extends at right angles thereto. The transversely extending section 190 thereby defines two lobes **190*a* and 190*b*. The respective lobe openings 190*a* and 190*b* is sufficiently large to permit a user to insert at least one finger into that respective lobe, drag the front coupon 184 across the opening and fold a portion of the front sheet outwardly of the stack of sheets 186 through the vertically extending section 188 of the opening. Such folding of the front sheet is demonstrated in FIG. 7, where the folded outward section 184*a* is moving outwardly through the vertical section 188 of the opening in the direction of arrow 194. It is appreciated, therefore, that the consumer may either extract the coupon by use of one finger to develop the folded portion 184*a*, or two fingers in the manner shown in FIG. 2 to develop the outwardly folded portion 30*a*. Depending upon the user being right or left handed, the right finger may be inserted in lobe 190*b* or the left finger may be inserted in lobe 190*a***.

Figure 7:
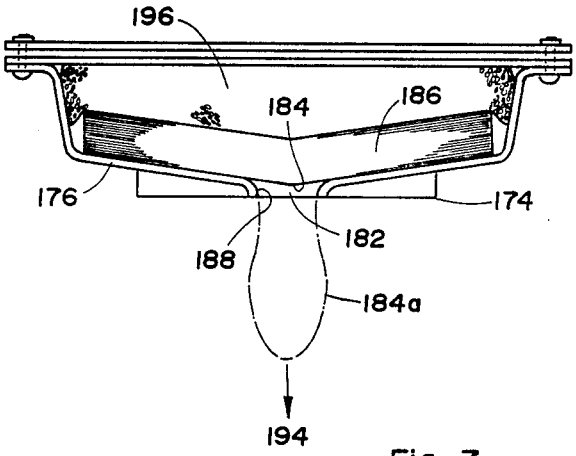
FIG. 7 is a lateral section through the coupon dispenser of FIG. 6 demonstrating extraction of a coupon therefrom.

It is appreciated that the opening 178 may have a variety of configurations. It is important, however, that the height of the opening not exceed appreciable the overall height of the stack of coupons to be dispensed. This is to ensure that one cannot insert a finger through the opening and grip an upper portion or lower portion of the stack and hence remove several coupons at one time from the dispenser. To thwart this activity with the embodiment shown in FIG. 6, flanges 180 and 182 extend outwardly from the top and bottom portions of the vertical section 188 of the opening. Such flanges prevent an individual from inserting a finger and gripping an upper or lower portion of the stack. As shown in FIG. 7, the lower flange 182 extends outwardly appreciably beyond the outer face of front coupon 184. Hence one is not able to insert a finger beneath the stack or correspondingly above the stack to grip several coupons at one time and remove same.

It is also appreciated that the front wall 172 of the enclosure may have the planar wall sections 174 and 176 lying generally in the same plane. Hence the stack of sheets 186 would essentially be flat rather than slightly convex to the extent shown in FIG. 7. With the sheets lying in the flat position, a user can still insert one or more fingers in the opening 178, cause a folding of the front sheet to move outwardly through the opening and complete withdrawal from the dispenser. However, the preferred arrangement of defining a slight angle between the planar wall sections 174 and 176 and hence between the halves the stack of sheets assists in the action of removing the front sheet. A slight concavity in sections 174 and 176 further helps removal.

An alternative arrangement for the device which urges the stack of sheets against the front wall portions 174 and 176 is shown in FIGS. 6 and 7. Instead of a spring element, a sponge material 196 is used. The sponge is compressible and has sufficient resilient memory to cause the stack of sheets 186 to bulge outwardly and take on the configuration of the outwardly sloping front wall sections 174 and 176 to induce the concave shape as shown in FIG. 7. With the vertical axis 192 of the opening 178 centered on the central portion of the stack of sheets near its outermost apex, the user can readily remove the front sheet of the stack of sheets with relative ease.

Figure 8:
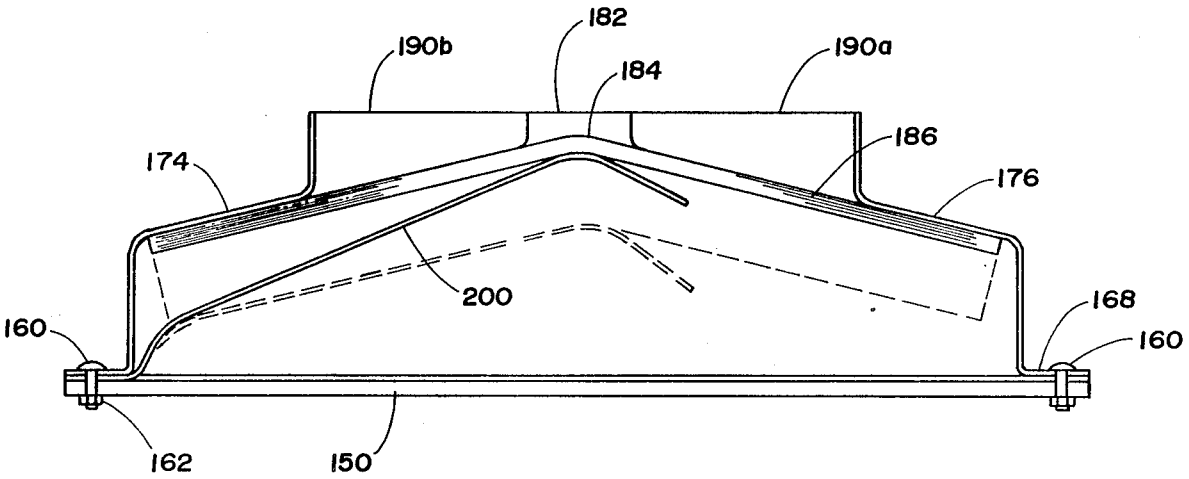
FIG. 8 is a lateral sectional view as in FIG. 7 except of an embodiment having a single side and a leaf spring for the coupons.

Another alternative embodiment is shown in FIG. 8 in which a single sided dispenser as in FIGS. 6 and 7 includes a leaf spring 200 in place of sponge 196 to bias the coupons against the front wall sections 174 and 176. The spring 200 is preferably of a stiff plastic material, although other materials such as a beryllium-copper alloy or steel could also be used, and is clamped on one side of the dispenser between plate 150 and flange 168. Such a spring is capable of a large displacement so as to accommodate a thick stack of coupons. The more coupons that can be loaded at one time the lower will be the servicing cost and inconvenience to the user.

In accordance with this invention, a sheet, dispenser is provided which is particularly suitable in dispensing dollar bill size sheets of material normally in the form of promotional coupons. The system is devised to be positioned adjacent the product being promoted to encourage movement of the product on the store shelves without detracting significantly from the overall appearance of the store shelf in displaying other products. Because the dispenser will only release one coupon at a time, the supplier of the product can confidently use this system to encourage the promotion of the product without jeopardizing their position by way of misuse of the promotional coupons.

Although preferred embodiments of the invention have been described herein in detail, it will be understood by those skilled in the art that variations may be made thereto without departing from the spirit of the invention or the scope of the appended claims.

I claim:

1. A sheet dispenser for dispensing sheets, comprising:

(a) a pair of separable hollow enclosures each having a front wall and an opening therein with a height dimension equal to the height dimension of said sheets and a width dimension sufficient to permit a user to insert at least one finger into said opening and fold a portion of a front sheet outwardly of a stack of sheets through said opening, each of said front walls having front wall portions inclined from the opening rearwardly towards the ends, forming planar or slightly concave surfaces, each of said enclosures for holding a stack of individual sheets and each having means for resiliently urging an associated stack of sheets against a corresponding one of said front walls; and (b) means for mounting a sidewall of said enclosures to a shelf edge such that said enclosures extend outwardly of such shelf edge with front walls thereof substantially perpendicular to said shelf edge.

2. A sheet dispenser according to claim 1, wherein said mounting means includes a flexible sheet connector member for connecting said enclosures to swing through a horizontal plane relative to the shelf on which said enclosure is mounted.

3. A sheet dispenser according to claim 1, including an outwardly extending flange around said opening to inhibit a user's finger from insertion onto a top or bottom edge of said stack of sheets.

4. A sheet dispenser according to claim 3, wherein said opening is located centrally of said front wall and includes a transversely extending section and a vertical section intersecting said transversely extending section midway thereof.

5. A sheet dispenser according to claim 4, wherein said urging means is a strip of rigid sheet material formed so that with the one end clamped an opposite end portion thereof is biased against a front face of said enclosure.

6. A sheet dispenser according to claim 1, wherein each enclosure front wall has two front wall portions inclined from said opening outwardly towards a respective encloser end and rearwardly forming planar or slightly concave surfaces.

7. A sheet dispenser according to claim 1, wherein said urging means biases said stack against an associated front wall even down to stacks of 1 sheet.

* * * * *